US005643027A

United States Patent [19]

Evans et al.

[11] Patent Number: 5,643,027

[45] Date of Patent: Jul. 1, 1997

[54] FREESTYLE STROKE SWIM TRAINING PADDLE

[75] Inventors: Marc P. Evans, Reno, Nev.; Peter M. Cazalet, Campbell, Calif.

[73] Assignee: Endurance Sport Technology Group, Inc., Chappaqua, N.Y.

[21] Appl. No.: 597,490

[22] Filed: Feb. 2, 1996

[51] Int. Cl.[6] ..... A63B 31/10

[52] U.S. Cl. ..... 441/58

[58] Field of Search ..... 441/55, 56, 57, 441/58; D21/237–239

[56] References Cited

U.S. PATENT DOCUMENTS

| | | | |
|---|---|---|---|
| Re. 28,855 | 6/1976 | Montrella . | |
| 183,045 | 10/1876 | Dunlop | 441/58 |
| D. 262,477 | 12/1981 | Lewis . | |
| D. 363,754 | 10/1995 | Johnson . | |
| 950,633 | 3/1910 | Eastman | 441/58 |
| 1,971,844 | 8/1934 | Babbitt | 441/58 |
| 3,417,415 | 12/1968 | Kozak | 441/58 |
| 4,316,300 | 2/1982 | Lewis . | |
| 4,721,300 | 1/1988 | Guzman . | |
| 4,913,418 | 4/1990 | Schlueter et al. . | |
| 5,288,254 | 2/1994 | Elson . | |
| 5,304,080 | 4/1994 | Dilger . | |
| 5,376,036 | 12/1994 | Hull . | |

OTHER PUBLICATIONS

Cappaert, et al., *Three–Dimensional Analysis of the Men's 100–m Freestyle During the 1992 Olympic Games,* Journal of Applied Biomechanics, 1995, pp. 103–112, ©1995 by Human Kinetics Publishers, Inc.

Schleihauf, et al., *Propulsive Techniques: Front Crawl Stroke, Butterfly, Backstroke, and Breaststroke,* Swimming Science V, Champaign, Illinois; Human Kinetics, 1988, pp. 53–59.

Catalyst™ Advertisement, TYR Sport, P.O. Box 1930, Huntington Beach, CA 92649, at least as early as Jan. 1996.

Han's Paddles Brochure, 1021 Westley Drive, Tacoma, Washington 98465, at least as early as Feb. 2, 1996.

Hannula, Dick, *Effective Paddle Training,* Source unknown, May 1992.

Hull, Martin, *Fulcrum High Speed Pull Paddles,* ©Martin Hull 1990 c/o Zoomers, P.O. Box 620476, Woodside CA 94062.

Strokemakers™ by Speedshop Int'l, Inc. brochure, at least as early as Feb. 2, 1996.

Smith, Hubert, "Skip", *The Illustrated Guide to Aerodynamics,* Tab Books Inc. ©1985, pp. 10–29, 44–45.

Donaldson, Sven, *A Sailor's Guide to Sails,* Dodd, Mead & Company, 79 Madison Avenue, New York, NY 10016, ©1984, pp. 4–7, 36–41.

*Primary Examiner*—Stephen Avila

*Attorney, Agent, or Firm*—Lee R. Osman

[57] ABSTRACT

A swim training paddle for attachment to the hand of a swimmer includes a main body member having an arcuate shape defining a convex upper surface and a concave lower surface, as well as having a finger securing loop attached to said upper surface to secure the paddle to the hand of a swimmer adjacent to the upper surface. The main body of the paddle defines an airfoil shape along its length and width to encourage the use of a curvilinear stroke path when using the freestyle stroke.

11 Claims, 4 Drawing Sheets

FREESTYLE STROKE SWIM TRAINING PADDLE

BACKGROUND OF THE INVENTION

1. Field of the Invention

The present invention relates generally to a training paddle for swimming, and more specifically to a training paddle that encourages a swimmer to use an efficient curvilinear stroke path.

2. Description of the Prior Art

The use of swim paddles as a means of improving upper body strength in swimmers is widely acknowledged. Such swim paddles are conventionally releasably attached to the swimmer's hands, and are used to increase the drag to which the swimmer is exposed while swimming.

Existing swim paddles are flat, and have a variety of shapes, some being square, some oval, and even some triangular in shape. Swim paddles are typically held on the swimmer's hand by a surgical tubing positioned through the paddle to form a finger loop. Sometimes a portion of surgical tubing is also used to secure the swimmer's wrist to the paddle in a similar manner. The ends of the tubing may extend through the paddle and protrude from the under surface of the paddle. Examples of existing paddles are shown in U.S. Pat. Nos. 5,376,036; 5,288,254; 4,913,418; and Re. 28,855.

A curvilinear stroke path has been found to be preferable to a straight stroke path. A curvilinear stroke path creates higher propulsive forces than a straight stroke path, and encourages a longer stroke length, both identified as necessities to swimming at a high level of competition.

The freestyle swimming stroke ideally includes several phases, shown schematically in FIG. 1, with the insweep portion and the upsweep portion providing the majority of the propulsive forces. In general, the hand enters the water and moves through the downsweep and catch portion A of the stroke to position the hand and arm for the insweep and upsweep phases of the stroke. During the insweep portion B of the stroke, the hand moves inward, upward and backwards to the midline of the body, during which time water passes across the hand from the thumb to the little finger. The hand is held at an angle and deflects the water away from the hand in a sculling motion, rather than pushing the water straight backwards. During the inward move, the swimmer feels lift and considerable hand pressure from the water. Those swimmers who are most efficient (elite v. non-elite) in sculling (propelling efficiency) are likely to perform at greater speeds. It is not strength or power generated that makes a faster swimmer, rather it is a swimmer's efficient engagement of the water that makes one swim faster.

After the insweep phase has been completed, the hand and arm move through the upsweep phase D where the fingertips are pointing toward the bottom of the pool and the palm faces backwards. In the upsweep phase, the water passes along the hand from the palm to the fingertips (outward, upward, and backward). A sculling action is also used in the upsweep phase where the hand is moved in diagonal skulls from side to side and not strictly backwards. The upsweep phase creates the highest propulsion and the majority of the forward movement experienced during the freestyle stroke.

After the upsweep portion of the stroke, the hand moves through the release portion E of the stroke where the hand and arm are positioned to leave the water. The elbow and hand actually leave the water during the recovery portion of the stroke, and the arm is brought forward to begin the stroke again.

The use of the presently available flat swim paddles do not facilitate the swimmer's use of the efficient sculling freestyle stroke just described because of the flat shape of the paddles. Flat paddles generate their greatest propulsive forces when the flow of water is perpendicular to the paddle, as shown in FIG. 2. When the flow of water is perpendicular to the paddle, the propulsive force results from drag. The swimmer finds the greatest propulsive force by pulling straight back, and so does not utilize the optimal curvilinear stroke path. The flat paddles are drag-dominant, creating a straighter sculling motion. Additionally, strength or propulsive forces are not what separate the elite swimmers. Rather, its the propelling efficiency of the swimmer, which results from a more efficient curvilinear stroke path. The use of the conventional flat paddle also shortens the swimmer's stroke as a result of the straight stroke path.

The sculling motions used in the insweep and the upsweep portions of the curvilinear freestyle stroke are known to generate a mixture of lift and drag in the swimmer's hand. In a study of Olympic swimmers, commentators have found that the most efficient swimming stroke for generating the highest speed for a swimmer includes the curvilinear stroke, and that lift and drag forces are about equally important in generating propulsion in the freestyle stroke. *Propulsive Techniques: Front Crawl Stroke, Butterfly, Backstroke, and Breaststroke,* Swimming Science V, 1988, at 53–59; Human Kinetics Publishers, Inc., R. E. Schleihauf, J. R. Higgins, R. Hinrichs, D. Luedtke, C. Maglischo, E. Maglischo and A. Thayer. It has been shown that the curvilinear stroke path allows for a higher propelling efficiency allowing a swimmer to use lower forces to achieve faster velocities. Lift in combination with the drag created by the movement of the swimmer's angled hand through the insweep and upsweep portions of the stroke motion, as opposed to drag alone, are believed to be key in generating a higher velocity using lower forces. It has also been found that the stroke length of the swimmer is also an important factor in generating a high velocity while swimming. *Three-Dimensional Analysis of the Men's* 100-*m Freestyle During the* 1992 *Olympic Games,* Journal of Applied Biomechanics, 1995, at 103–112, Human Kinetics Publishers, Inc., J. M. Cappaert, D. L. Pease, and J. P. Troup.

There is a need in the art for a swim training paddle designed to utilize a combination of lift and drag forces and to encourage the use of the curvilinear stroke path in the freestyle stroke. It is to overcome these shortcomings in the prior art that the present invention was developed.

SUMMARY OF INVENTION

The present invention relates to a swim training paddle for encouraging the use of a curvilinear stroke path while swimming, and more particularly to a paddle having an airfoil shape suited specifically for the freestyle stroke. In the preferred embodiment of the present invention, a swim training paddle for attachment to the hand of a swimmer includes a main body member having an arcuate shape and defining a convex upper surface and a concave lower surface. The paddle also includes a finger securing loop attached to the upper surface to secure the paddle to the hand of a swimmer. More particularly, the upper surface of the paddle includes a length, a front edge, and a rear edge, with the main body member defining an airfoil shape along its length. The airfoil shape is defined by a chord length which is measured in a straight line between the front and rear edges, a maximum height from the chord length to the upper surface, and a location of the maximum height as measured from the leading edge. Preferably, the chord length is from approximately 4 to 10 inches long, the maximum height is from approximately 5% to 25% of the chord length, and the location of the maximum height is from approximately 25% to 50% of the chord length. The main body member also defines a width, an inner edge, and an outer edge, with the main body member defining an airfoil shape along its width. The airfoil shape is defined by a chord width measured in a straight line between the inner and outer edges, a maximum height from the chord width to the upper surface, and a location of the maximum height as measured from the leading edge. Preferably, the chord width is from approximately 2 to 8 inches, the maximum height from the chord width to the upper surface is from approximately 5% to 25% of the chord width, and the location of maximum height from the chord width approximately 25% to 50% of the chord width.

Use of the paddle of the present invention when practicing the freestyle stroke encourages the swimmer to utilize the curvilinear stroke path by accentuating the feeling of lift generated by the airfoil shape during particular portions of the stroke path.

Accordingly, it is a primary object of the invention to provide a swim paddle to encourage the use of a curvilinear stroke path when using the freestyle stroke.

It is another object of the present invention to increase the stroke length of the swimmer by encouraging the use of a curvilinear stroke path.

Still another object of the present invention is to provide a paddle for use while swimming that accentuates the sense of lift, and the advantageous propulsive effects thereof.

Other aspects, features and details of the present invention can be more completely understood by reference to the following detailed description of the preferred embodiment, taken in conjunction with the drawings, and from the appended claims.

DESCRIPTION OF THE PREFERRED EMBODIMENT

Figure 3:
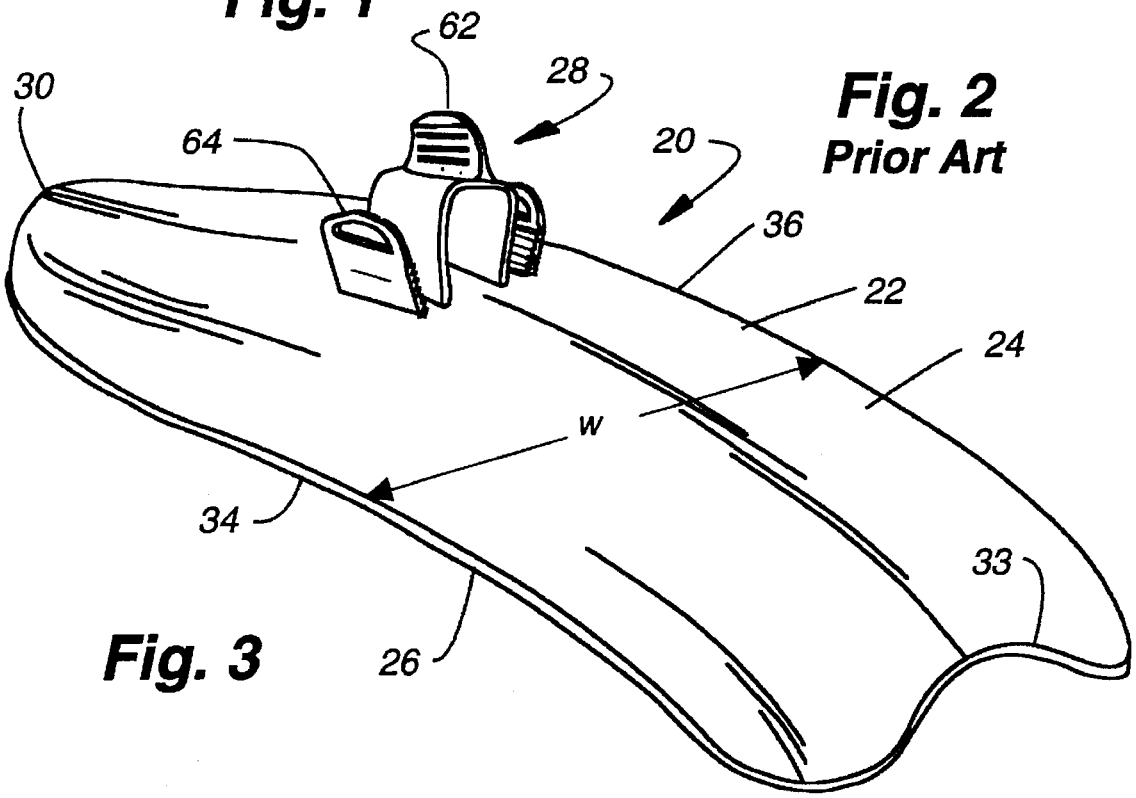
FIG. 3 is a perspective view of a swim paddle incorporating the present invention, and illustrates a main body member having a concave lower surface, a convex upper surface and a finger loop.

Referring first to FIG. 3, a swim training paddle 20 of the present invention is illustrated which includes a rigid main body member 22 having a convex upper surface 24 and a concave lower surface 26. The paddle 20 also includes an adjustable finger securing loop 28 extending from the upper surface 24 of the paddle 20. The swim training paddle 20 is worn on the hand of the swimmer, with the hand being positioned on the upper concave surface 24 of the paddle with the swimmer's middle finger extending through the finger-securing loop 28 to releasably attach the paddle 20 to the swimmer's hand. When used as a training aid, more particularly when used while practicing the freestyle stroke, the curved shape of the paddle 20 encourages the swimmer to utilize the optimal curvilinear stroke path in order to maximize the combined benefits of the lift and drag phenomena to create propulsive force when moving the hand through the water during the stroke, as is described in greater detail below.

Figure 4:
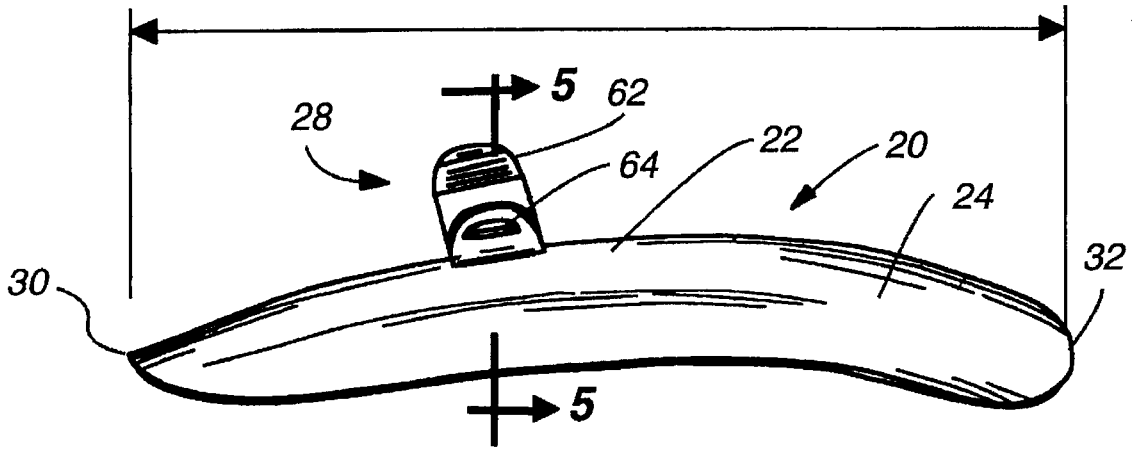
FIG. 4 is a left side view of the swim paddle of the present invention.
Figure 8:
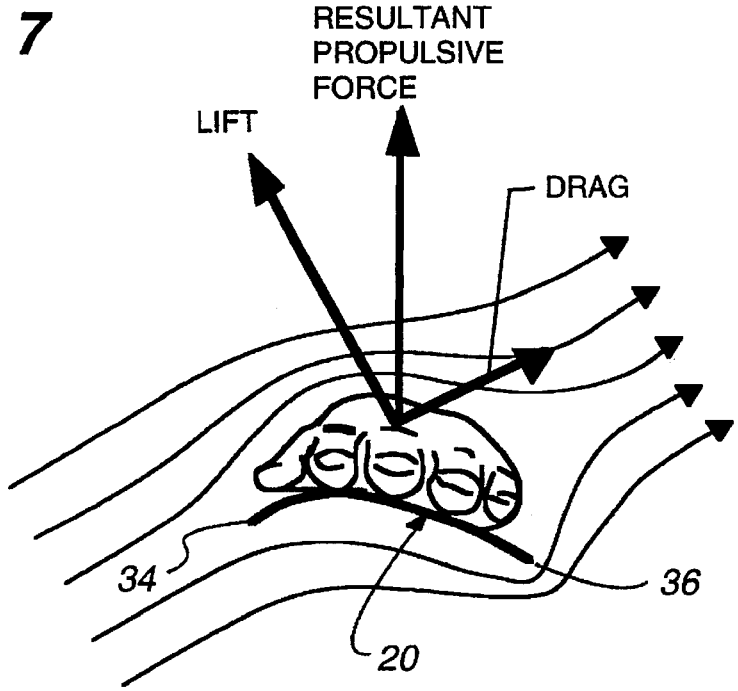
FIG. 8 is a representational view of the water flow around the paddle of the present invention during the insweep portion of the freestyle stroke, and illustrates the lift, drag, and resultant propulsive forces associated therewith.
Figure 9:
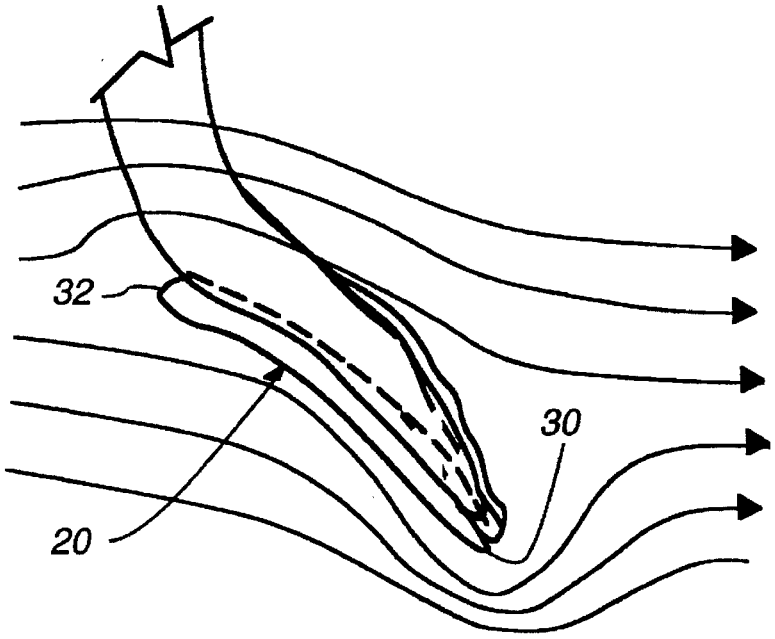
FIG. 9 is a representational view of the water flow around the paddle of the present invention during the upsweep portion of the freestyle stroke.

Referring now to FIGS. 3 and 4, the main body 22 of the paddle 20 is shown as defining a front edge 30, a rear edge 32, an inner edge 34 and an outer edge 36. The length "L" of the paddle between the front edge 30 and the rear edge 32 defines an arcuate shape with the upper surface 24 being convex and the lower surface 26 being concave. The width "W" between the inner edge 34 and the outer edge 36 also defines an arcuate shape with the upper surface 24 being convex and the lower surface 26 being concave. The overall size of the paddle 20 conforms roughly with the size of a person's hand with the front edge 30 adjacent to the tips of the person's fingers, the rear edge 32 adjacent to the palm of the person's hand, the inner edge 34 adjacent to the thumb of the person's hand and the outer edge 36 adjacent to the little finger of the person's hand, as shown in FIGS. 8 and 9. A portion 33 of the rear edge 32 of the paddle 20 curves slightly towards the front edge 30 in order to fit along the base of the palm more precisely and to not interfere with the wrist flexion.

Figure 5:
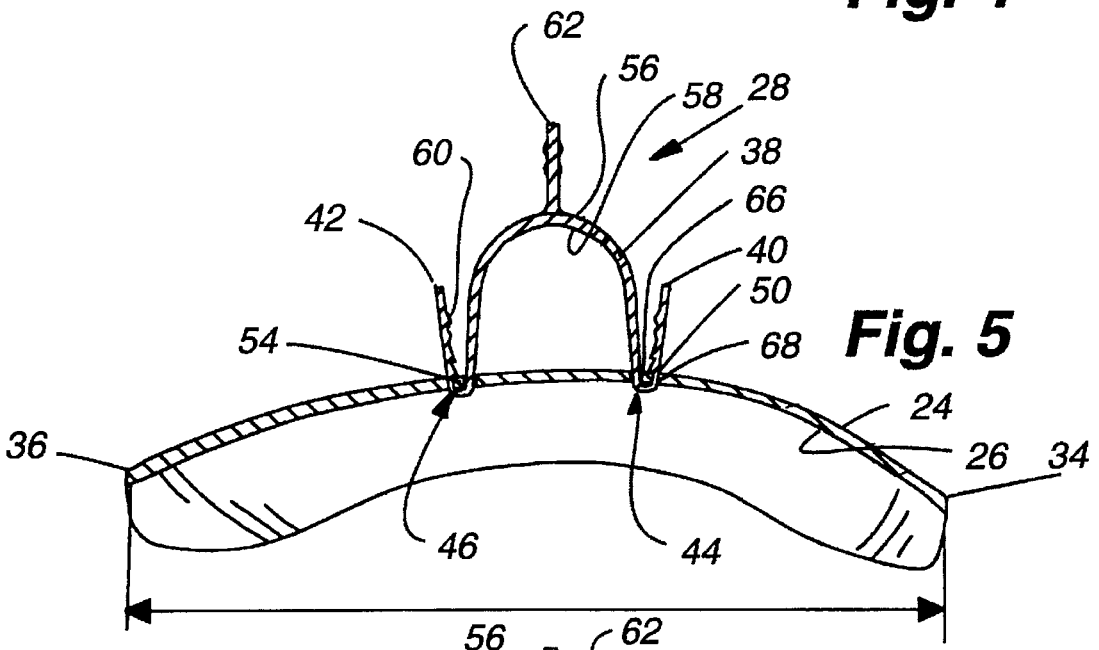
FIG. 5 is a section taken along line 5—5 of FIG. 4, and illustrates the airfoil shape across the width of the paddle.
Figure 6:
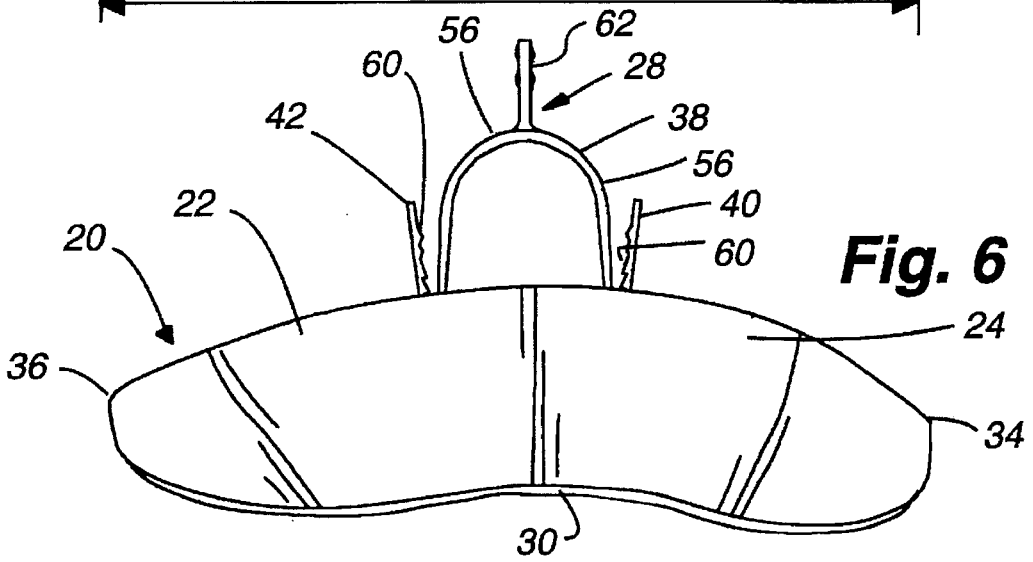
FIG. 6 is a front view of the paddle of the present invention.

The paddle 20 is releasably attached to the hand by use of the finger securing loop 28. See FIGS. 3, 5 and 6. The finger securing loop 28 is an elongated strap 38 having a first end 40 and a second end 42. The finger loop 28 can be made of a silicone rubber to provide a soft comfortable fit. Two pair of slots, an inner pair 44 and an outer pair 46, are formed through the main body 22 of the paddle 20 at a location centrally located across the width of the paddle, and also generally centrally located along the length of the paddle. The pairs of slots 44 and 46 are used to adjustably secure the opposite ends of the strap to the paddle. The inner pair 44 of slots has a first slot 48 and a second slot 50, and the outer pair 46 of slots has a third slot 52 and a fourth slot 54.

The finger securing strap 28 has a top side 56 and a bottom side 58. Serrations 60 can be formed on either the top 56 or bottom 58 side of the strap adjacent to either end 40, 42, and extend from either end towards the center of the strap 38. As shown, the serrations 60 are formed on the top side 56 of the strap 38 to avoid aggravating the adjacent fingers. A pull tab 62 protrudes outwardly from the top side 56 of the strap 38 and is positioned at the center of the length of the strap. The pull tab 62 assists in easing the finger entry into the finger securing loop 28 when in use, as is described further below.

An aperture 64 is formed through the strap 38 at either end to provide a convenient grip for the swimmer when adjusting the strap 38 on the paddle 20.

All of the slots 48, 50, 52 and 54 are aligned to extend co-extensively with one another to facilitate threading the strap 38 through the slots. To position the finger securing loop 28 on the paddle 22, one end 40 of the strap is inserted through the first slot 48 in the inner pair 44 of slots, to extend downwardly from the top surface 24 through the slot 48 to the bottom surface 26 of the paddle 20. That same end 40 is then threaded upwardly through the second slot 50 of the inner pair 44 of slots from the bottom surface 26 through the slot 50 to the top surface 24 and extends therethrough. The serrations 60 engage the outer edge 66 of the first slot 48 and the inner edge 68 of the second slot 50 to help fix the position of the strap 38 as inserted into the slots 48 and 50. The other end 42 of the strap 38 is identically threaded through the third 52 and fourth 54 slots in the outer pair 46 of slots, creating a loop 28 formed by the strap 38 extending above the top surface 24 of the paddle 20 between the two pairs of slots 44 and 46.

To utilize the finger securing loop 28 to attach the paddle 20 to the hand, the swimmer first adjusts the size of the loop 28 extending over the top surface 24 of the paddle 20 by pulling the ends 40, 42 further through the slots 48, 50, 52 and 54 to make the loop 28 smaller, or pushing some of the strap 38 back through the slots 48, 50, 52 and 54 to make the loop 28 larger. Once the loop 28 is properly sized for the swimmer's finger, the swimmer grips the pull tab 62 and pulls upwardly to stretch the strap 28, which allows the finger to be inserted more easily. The finger loop 28 should not change size when the pull tab 62 is used because of the threading of the strap 38 in conjunction with the serrations 60. When the pull tab 62 is released once the finger is inserted, the strap 38 contracts back to its normal size and fits snugly around the swimmer's finger. The paddle 20 is thus held securely on the hand of the swimmer.

Typically the swimmer's middle finger is inserted through the loop 28 to result in the optimal placement of the paddle 20 on the swimmer's hand. It is contemplated that more than one of the aforementioned finger securing loops 28 may be used to more securely attach the paddle 20 to the swimmer's hand. The strap 38 extends along only a small portion of the lower surface 26 of the paddle 20, between the individual slots 48 and 50, and between slots 52 and 54, to minimize the interference with the flow of the water under the paddle 20 when in use.

Figure 7:
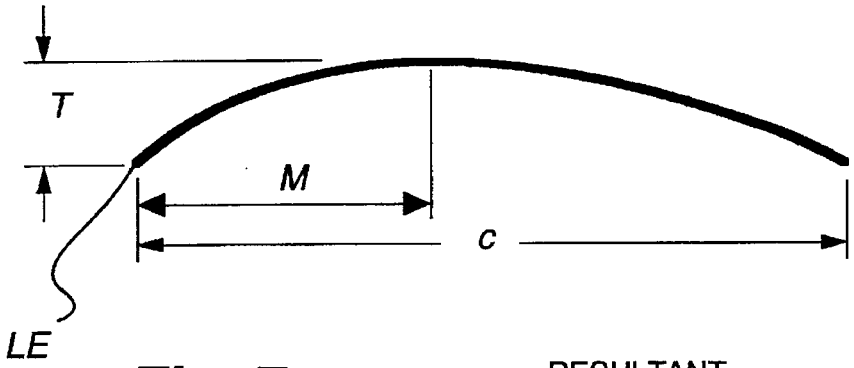
FIG. 7 is a schematic representation of the model airfoil shape used in designing the length and width profiles of the paddle of the present invention.
Figure 10:
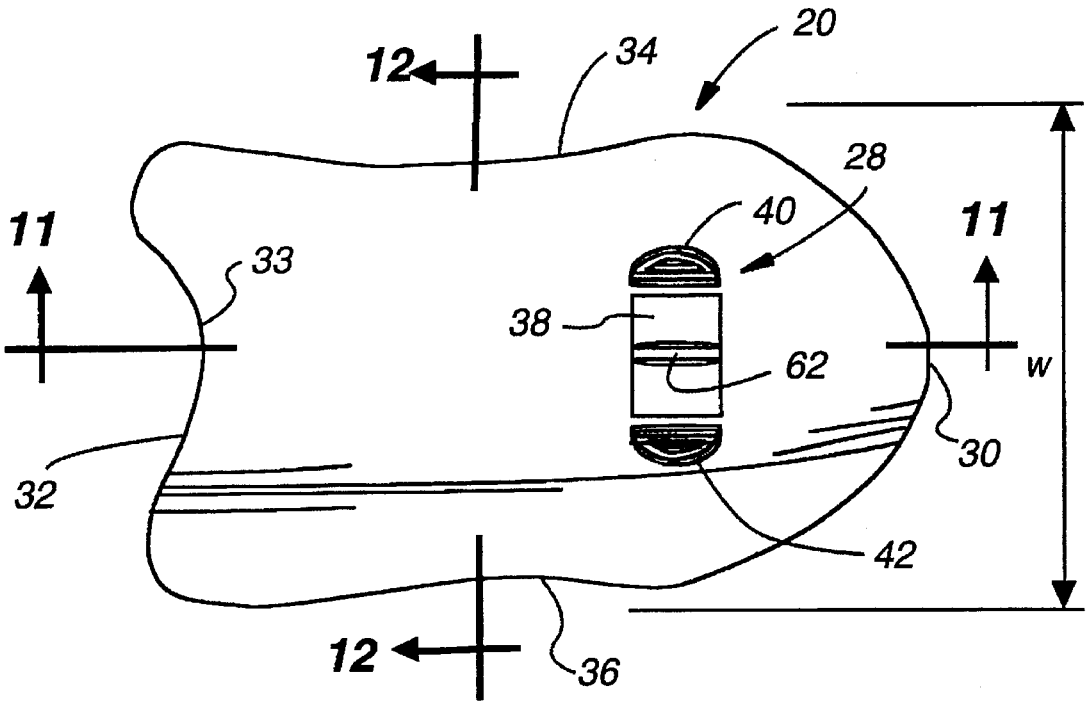
FIG. 10 is a top view of the paddle of the present invention.
Figure 11:
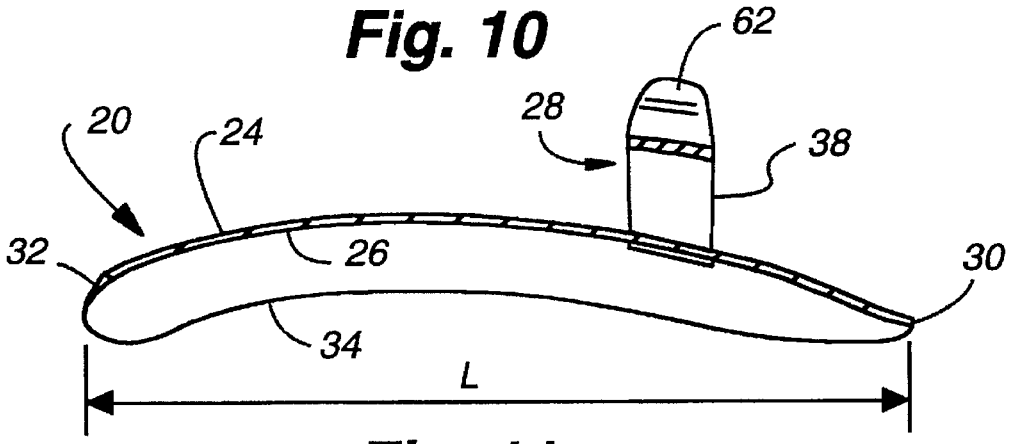
FIG. 11 is a section taken along line 11—11 of FIG. 10.
Figure 12:
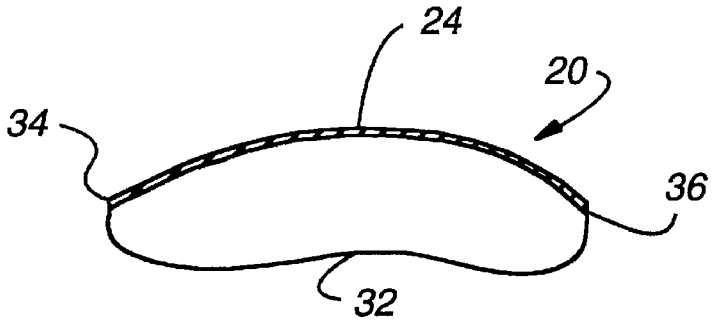
FIG. 12 is a section view taken along line 12—12 of FIG. 10.

The main body 22 of the paddle 20 is designed to have an air foil shape along both its length and width dimensions. The paddle 20 can be constructed of a thermoplastic polycarbonate having high impact resistance and good formability. Alternatively, other materials having good formability combined with adequate stiffness could also be used. The thickness of the paddle is preferably approximately one-eighth of an inch. Preferably, the same air foil shape is used in both the width and length dimensions. The preferred air foil shape is shown in FIG. 7, and has three important dimensions: (1) chord length "C"; (2) maximum height dimension "T"; and (3) location "M" of the maximum height, as measured from the leading edge "LE" of the air foil shape. Both the length dimension and the width dimension, as shown in FIGS. 10 and 11, respectively, utilize this air foil shape. The length dimensions of the air foil shape shown in FIGS. 10 and 11, "CL", "TL" and "ML", correspond to dimensions "C", "T" and "M" of FIG. 7, respectively, with the chord length "CL" of the paddle 20 based on the length of the swimmer's hand. The width dimensions of the air foil shape shown in FIGS. 10 and 11, "CW", "TW" and "MW", correspond to dimensions "C", "T" and "M" of FIG. 7, respectively, with the chord length "CW" of the paddle 20 based on the width of the swimmer's hand. By utilizing the air foil design shown in FIGS. 7, 10 and 11, the chord or overall length or width of the paddle can be changed while maintaining the shape of the air foil.

Preferably, the maximum height dimension "TL" is from 5% to 25%, inclusive, of the chord length "CL", and the location "ML" of the maximum height dimension is from 25% to 50%, inclusive of the chord length "CL". Preferably, the maximum height dimension "TW" is from 5% to 25%, inclusive, of the chord length "CW", and the location "MW" of the maximum height dimension is from 25% to 50%, inclusive of the chord length "CW". It should be understood that the chord lengths "CL" and "CW of the paddle 20 can be modified as necessary to adjust for different hand shapes and sizes, with the typical length of a swimmer's hand being from approximately four (4) to sixteen (16) inches, and the width being from approximately three (3) to ten (10) inches.

Most preferably, the maximum height dimension "TL" of the air foil is 15% of the chord length "CL", while the ideal location of the maximum height dimension "ML" is 40% of the length "CL" as measured from the leading edge "LE" of the air foil shape. Similarly, the most preferable dimensions include a maximum height dimension "TW" of the air foil which is 15% of the chord length "CW", while the ideal location of the maximum height dimension "MW" is 40% of the length "CW" as measured from the leading edge "LE" of the air foil shape.

As an example using the preferred dimensions, if the length of the swimmer's hand is eight inches, and the width of the swimmer's hand is approximately four inches, the maximum height dimension "TL" in the length dimension is 15% of eight inches, or 1.2 inches. The location "ML" of the maximum height dimension from the leading edge "LE" (rear edge 32), is 40% of eight inches, or 3.2 inches. Accordingly, for the air foil shape across the width of the paddle, the maximum height dimension "TW" is 15% of four inches, or 0.6 inches. The location "MW" of the maximum height dimension, is 40% of the chord length "CW" in the width dimension, or 1.6 inches from the leading edge (inner edge 34).

When the paddle 20 is formed with the air foil shape along its length "L", and along its width "W" the leading edge "LE" of the air foil shape along the length of the paddle 20 is co-extensive with the rear edge 32 of the paddle 20 which is positioned near the palm of the swimmer. The leading edge "LE" of the air foil shape across the width "W" of the paddle 20 is co-extensive with the inner 34 edge of the paddle 20, which is adjacent to the thumb of the swimmer. Given the unique air foil design of the length and width cross sections of the paddle 20, there is a designated right hand paddle and a designated left hand paddle.

In operation, the swim training paddle 20 of the present invention encourages the swimmer to utilize the efficient and advantageous curvilinear stroke path during the freestyle stroke. The air foil shape of the paddle 20 in both its length "L" and width "W" dimensions help the swimmer realize the benefits of the sculling motion in the insweep and the upsweep portions of the stroke. The sculling motion, with the air foil shaped paddle 20, accentuates the benefits of utilizing a combination of both lift and drag to result in the propulsive force necessary to move quickly through the water, as opposed to using purely drag forces to generate the propulsive force as is encouraged by the paddles having flat cross sectional shapes.

Figure 1:
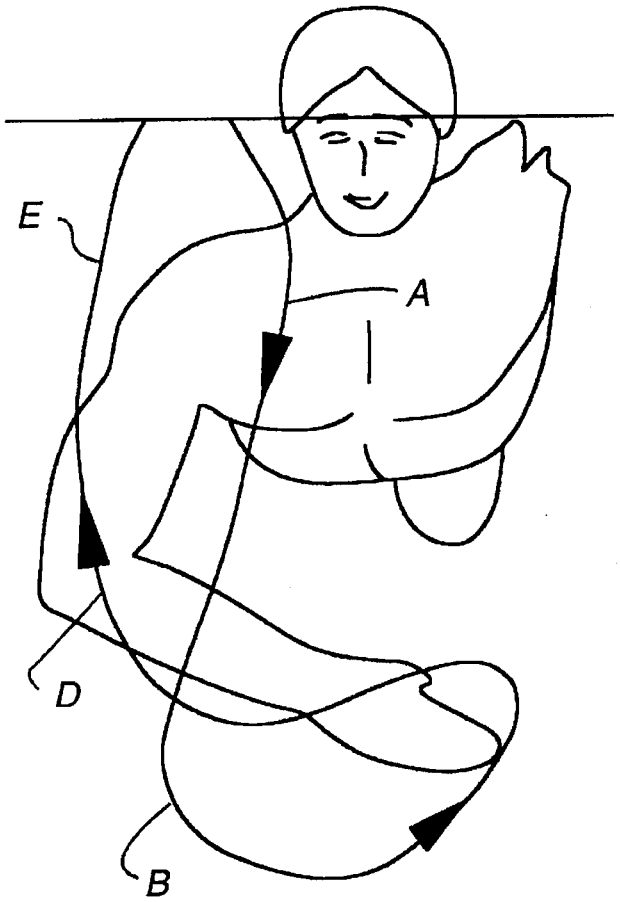
FIG. 1 is a frontal view schematic representation of the hand and arm motions of a swimmer using the freestyle stroke.
Figure 2:
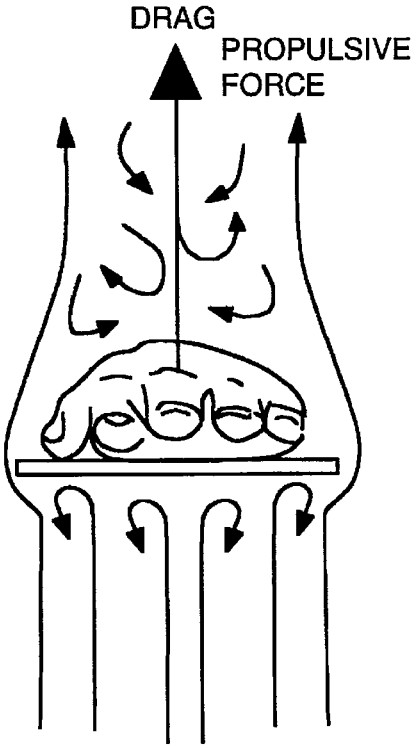
Fig. 2 Prior Art
FIG. 2 is a depiction of the flow of water over a prior art flat swim paddle, illustrating the drag effect and the resulting propulsive force.

As depicted in FIGS. 1 and 8, in the insweep phase B the swimmer's hand is moved toward the midline of the swimmer's body and toward the swimmer's waist while the hand is held at an angle, thus causing the water to flow from the thumb to the little finger to take advantage of the lift created by the air foil shape. In both of these instances, the propulsive force is derived from a combination of the lift created by the air foil and the drag created by the movement of the paddle through the water, as schematically depicted in FIG. 8. More specifically, the air foil shape along the width of the paddle is responsible for creating lift during the insweep portion of the stroke, where the flow of water passes across the hand from the thumb to the little finger, as shown in FIG. 8. The leading edge LE of the air foil shape along the width of the paddle 20 is on the inner edge 34 of the paddle 20, adjacent to the thumb, such that the benefit of the lift generated by the air foil shape is obtained during the insweep phase.

As depicted in FIGS. 1 and 9, the air foil shape along the length "L" of the paddle 20 is responsible for creating lift during the upsweep phase of the stroke when the water flows from the palm to the fingertips. The leading edge "LE" of the air foil shape along the length, L, of the paddle 20 is co-extensive with the rear edge 32 of the paddle 20, which is adjacent to the palm of the swimmer when in use. In the upsweep phase, the swimmer's fingers are pointing generally downwardly towards the bottom of the pool with the palm pointing generally rearwardly and towards the surface of the water while the hand is being moved backwards by the swimmer, causing the water to flow from the palm of the swimmer's hand across the fingertips, thus taking advantage of the lift generated by the air foil shape, as shown in FIG. 9.

By using the air foil shaped swim paddle of the present invention, a swimmer is encourages to use a curvilinear stroke path to take advantage of the combination of lift and drag forces in generating a more efficient propulsive force. A longer stroke length is also encouraged.

Although the present invention has been described with a certain degree of particularity, it is understood that the present disclosure has been made by way of example, and changes in detail or structure may be made without departing from the spirit of the invention, as defined in the appended claims.

We claim:

1. A swim training paddle for attachment to the hand of a swimmer, the hand having a palm and fingers extending therefrom, said paddle comprising:

a main body member having an upper surface and defining a length, a front edge adapted to be adjacent the fingers, and a rear edge adapted to be adjacent the palm; and said main body member defining an airfoil shape along its length, said rear edge of said main body defining a leading edge, said airfoil shape defined by a chord, CL, measured in a straight line between the front and rear edges, a maximum height, TL, from the chord to said upper surface, and a location of the maximum height, ML, as measured from said leading edge, where TL is closer to said leading edge than to said front edge.

2. A swim paddle as defined in claim 1, wherein CL is from approximately 4 to 10 inches, TL is from approximately 5 to 25 percent of CL, and ML is from approximately 25 to 50 percent of CL limits on length.

3. A paddle as defined in claim 2, wherein:

TL equals 15 percent of CL, and ML equals 40 percent of CL.

4. A paddle as defined in claim 2 further comprising:

a finger securing loop attached to said upper surface to secure said paddle to the hand of a swimmer adjacent said upper surface.

5. A swim training paddle for attachment to the hand of a swimmer, the hand having a thumb and little finger extending therefrom, said paddle comprising:

a main body member having an upper surface and defining a width, an inner edge adapted to be adjacent the thumb, and an outer edge adapted to be adjacent the little finger; and said main body member defining an airfoil shape along its width, said inner edge defining a leading edge, said airfoil shape defined by a chord, CW, measured in a straight line between the inner and outer edges, a maximum height, TW, from the chord to said upper surface, and a location of the maximum height, MW, as measured from the leading edge, where said TW is closer to said leading edge than to said outer edge.

6. A swim paddle as defined in claim 5, wherein CW is from approximately 4 to 10 inches, TW is from approximately 5 to 25 percent of CW, and MW is from approximately 25 to 50 percent of CW.

7. A paddle as defined in claim 6, wherein:

TW equals 15 percent of CW, and MW equals 40 percent of CW.

8. A swim training paddle for attachment to the hand of a swimmer, said paddle comprising:

a main body member having an arcuate shape, and defining a convex upper surface and a concave lower surface;

a first pair of slots being formed in the main body and positioned generally centrally on said main body, said pair of slots having a first and second slot;

a second pair of slots being formed in the main body and positioned generally centrally on said main body, said second pair of slots having a first and second slot;

an elongated flexible strap having opposing first and second ends, where said first end is inserted through said first slot of said first pair of slots from said top surface, and inserted through said second slot of said first pair of slots from said bottom surface to extend above said upper surface, and where said second end is inserted through said first slot of said second pair of slots from said top surface, and inserted through said second slot of said second pair of slots from said bottom surface to extend above said upper surface, and said strap thus forming a finger loop for attaching the paddle to the swimmer extending above the upper surface between said first and second pair of slots; and a pull tab extending upwardly from said finger loop for temporary enlargement of said finger loop during attachment of said paddle to the swimmer.

9. A paddle as defined in claim 8, wherein said strap has an upper surface and a lower surface, and wherein:

a plurality of serrations are formed on said upper surface of said strap adjacent to both said first and said second ends.

10. A swim training paddle for attachment to the hand of a swimmer, the hand having a palm and a thumb and little finger extending therefrom, said paddle comprising:

a main body member having an upper surface and defining a length, a front edge adjacent the fingers, a rear edge adjacent the palm, an inner edge adjacent the thumb and an outer edge adjacent the little finger;

said main body member defining an airfoil shape along its length, said rear edge of said main body defining a leading edge for the length, said airfoil shape defined by a chord, CL, measured in a straight line between the front and rear edges, a maximum height, TL, from the chord to said upper surface, and a location of the maximum height, ML, as measured from said leading edge, where TL is closer to the leading edge than to the front edge; and said main body member defining an airfoil shape along its width, said inner edge defining a leading edge, said airfoil shape defined by a chord, CW, measured in a straight line between the inner and outer edges, a maximum height, TW, from the chord to said upper surface, and a location of the maximum height, MW, as measured from the leading edge, where TW is closer to the leading edge than to the outer edge.

11. A swim paddle as defined in claim 10, wherein:

CL is from approximately 4 to 10 inches, TL is from approximately 5 to 25 percent of CL, and ML is from approximately 25 to 50 percent of CL; and wherein CW is from approximately 4 to 10 inches, TW is from approximately 5 to 25 percent of CW, and MW is from approximately 25 to 50 percent of CW.

* * * * *